US009599941B2

(12) United States Patent
Yamaguchi et al.

(10) Patent No.: US 9,599,941 B2
(45) Date of Patent: Mar. 21, 2017

(54) HEATER FOR HEATING A FIXING ROTATOR OF A FIXING DEVICE AND IMAGE FORMING APPARATUS INCORPORATING THE SAME

(71) Applicants: Yoshiki Yamaguchi, Kanagawa (JP); Kazuhito Kishi, Kanagawa (JP); Yasunori Ishigaya, Kanagawa (JP); Ippei Fujimoto, Kanagawa (JP); Keisuke Kawabata, Kanagawa (JP); Haruyuki Honda, Kanagawa (JP)

(72) Inventors: Yoshiki Yamaguchi, Kanagawa (JP); Kazuhito Kishi, Kanagawa (JP); Yasunori Ishigaya, Kanagawa (JP); Ippei Fujimoto, Kanagawa (JP); Keisuke Kawabata, Kanagawa (JP); Haruyuki Honda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/582,365

(22) Filed: Dec. 24, 2014

(65) Prior Publication Data

US 2015/0177655 A1 Jun. 25, 2015

(30) Foreign Application Priority Data

Dec. 25, 2013 (JP) ..... 2013-267748
Oct. 28, 2014 (JP) ..... 2014-219418

(51) Int. Cl.
*G03G 15/20* (2006.01)

(52) U.S. Cl.
CPC . *G03G 15/2057* (2013.01); *G03G 2215/2035* (2013.01)

(58) Field of Classification Search
CPC .. G03G 15/206; G03G 15/20; G03G 15/2003; G03G 15/2014
USPC ..... 399/329, 328, 330, 325, 335, 333
See application file for complete search history.

(56) References Cited

U.S. PATENT DOCUMENTS

| | | | | |
|---|---|---|---|---|
| 7,359,666 | B2 * | 4/2008 | Takashi | G03G 15/167 399/307 |
| 7,953,360 | B2 * | 5/2011 | Kagawa | G03G 15/2057 399/328 |
| 2006/0115305 | A1 * | 6/2006 | Lofthus | G03G 15/2007 399/328 |
| 2011/0206427 | A1 * | 8/2011 | Iwaya | G03G 15/2053 399/329 |

(Continued)

FOREIGN PATENT DOCUMENTS

| | | |
|---|---|---|
| JP | 6-222696 | 8/1994 |
| JP | 7-168471 | 7/1995 |

(Continued)

OTHER PUBLICATIONS

U.S. Appl. No. 14/484,769, filed Sep. 12, 2014.
U.S. Appl. No. 14/446,812, filed Jul. 30, 2014.
U.S. Appl. No. 14/470,203, filed Aug. 27, 2014.

*Primary Examiner* — Billy Lactaoen
(74) *Attorney, Agent, or Firm* — Oblon, McClelland, Maier & Neustadt, L.L.P.

(57) ABSTRACT

A fixing device includes a fixing rotator rotatable in a predetermined direction of rotation and including a heated face and a heater including a contact face contacting the heated face of the fixing rotator. The contact face has a Vickers hardness not greater than about 600 Hv.

18 Claims, 7 Drawing Sheets

(56) References Cited

U.S. PATENT DOCUMENTS

| | | | | |
|---|---|---|---|---|
| 2012/0121284 | A1* | 5/2012 | Iwasaki | G03G 15/2064 399/67 |
| 2012/0263509 | A1* | 10/2012 | Yokoyama | G03G 15/2053 399/329 |
| 2014/0219672 | A1 | 8/2014 | Samei et al. | |
| 2014/0219673 | A1 | 8/2014 | Yamamoto et al. | |
| 2014/0219696 | A1 | 8/2014 | Fujimoto et al. | |
| 2014/0226999 | A1 | 8/2014 | Kishi | |
| 2014/0227001 | A1 | 8/2014 | Kishi et al. | |
| 2014/0294473 | A1 | 10/2014 | Ono et al. | |

FOREIGN PATENT DOCUMENTS

| | | | | |
|---|---|---|---|---|
| JP | 7-219365 | | 8/1995 | |
| JP | 09269687 | A * | 10/1997 | G03G 15/20 |
| JP | 2001-223063 | | 8/2001 | |
| JP | 2002-055546 | | 2/2002 | |
| JP | 2008-134302 | | 6/2008 | |
| JP | 2011-197020 | | 10/2011 | |

* cited by examiner

HEATER FOR HEATING A FIXING ROTATOR OF A FIXING DEVICE AND IMAGE FORMING APPARATUS INCORPORATING THE SAME

CROSS-REFERENCE TO RELATED APPLICATIONS

This patent application is based on and claims priority pursuant to 35 U.S.C. §119 to Japanese Patent Application Nos. 2013-267748, filed on Dec. 25, 2013, and 2014-219418, filed on Oct. 28, 2014, in the Japanese Patent Office, the entire disclosure of each of which is hereby incorporated by reference herein.

BACKGROUND

Technical Field

Exemplary aspects of the present disclosure relate to a heater, a fixing device, and an image forming apparatus, and more particularly, to a heater for heating a fixing rotator that fixes a toner image on a recording medium, a fixing device incorporating the heater, and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved fixing device. In one exemplary embodiment, the fixing device includes a fixing rotator rotatable in a predetermined direction of rotation and including a heated face and a heater including a contact face contacting the heated face of the fixing rotator. The contact face has a Vickers hardness not greater than about 600 Hv.

This specification further describes below an improved heater for heating a fixing rotator for fixing a toner image on a recording medium. In one exemplary embodiment, the heater includes a contact face contacting the fixing rotator and having a Vickers hardness not greater than about 600 Hv.

This specification further describes an improved image forming apparatus. In one exemplary embodiment, the image forming apparatus includes an image bearer to bear a toner image and a fixing device, disposed downstream from the image bearer in a recording medium conveyance direction, to fix the toner image on a recording medium. The fixing device includes a fixing rotator rotatable in a predetermined direction of rotation and including a heated face and a heater including a contact face contacting the heated face of the fixing rotator. The contact face has a Vickers hardness not greater than about 600 Hv.

BRIEF DESCRIPTION OF THE DRAWINGS

A more complete appreciation of the disclosure and the many attendant advantages thereof will be readily obtained as the same becomes better understood by reference to the following detailed description when considered in connection with the accompanying drawings, wherein.

DETAILED DESCRIPTION OF THE DISCLOSURE

Figure 1:
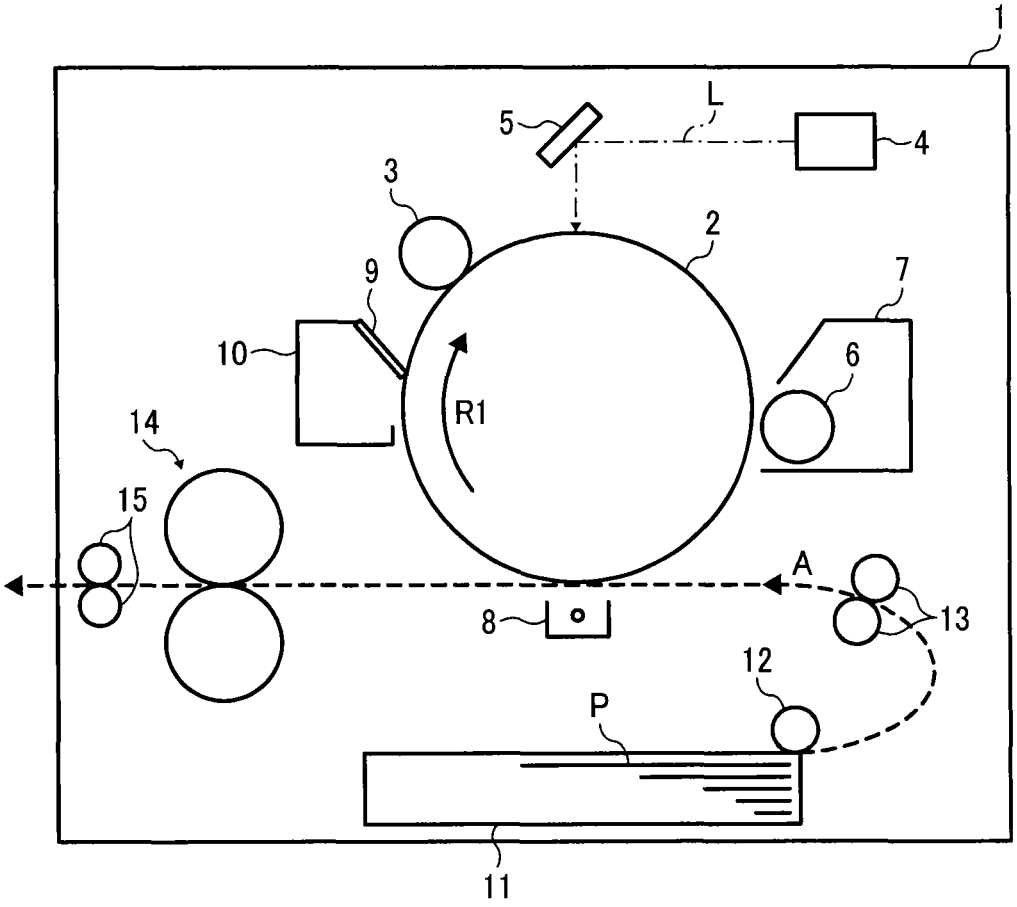
FIG. 1 is a schematic vertical sectional view of an image forming apparatus according to an exemplary embodiment of the present disclosure.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present disclosure is explained.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a monochrome printer that forms a monochrome toner image on a recording medium by electrophotography.

With reference to FIG. 1, a description is provided of a construction of the image forming apparatus 1.

It is to be noted that, in the drawings for explaining exemplary embodiments of this disclosure, identical reference numerals are assigned, as long as discrimination is possible, to components such as members and component parts having an identical function or shape, thus omitting description thereof once it is provided.

As shown in FIG. 1, the image forming apparatus 1 is a monochrome printer that includes a photoconductor 2 serving as an image bearer situated in a center portion thereof. The photoconductor 2 is surrounded by a charging roller 3, a light source 4 and a mirror 5 that constitute an exposure device, a developing device 7 incorporating a developing roller 6, a transfer device 8, and a cleaner 10 incorporating a cleaning blade 9, which form a toner image on the photoconductor 2.

The image forming apparatus 1 further includes a paper tray 11 that loads a plurality of sheets P serving as recording media, a feed roller 12 that picks up and feeds a sheet P from the paper tray 11, a registration roller pair 13, a fixing device 14 that fixes the toner image transferred from the photoconductor 2 onto the sheet P thereon, and an output roller pair 15 that ejects the sheet P bearing the fixed toner image onto an outside of the image forming apparatus 1. The sheets P may be thick paper, postcards, envelopes, plain paper, thin paper, coated paper, art paper, tracing paper, overhead projector (OHP) transparencies, and the like. Optionally, a bypass tray that loads thick paper, postcards, envelopes, thin paper, coated paper, art paper, tracing paper, OHP transparencies, and the like may be attached to the image forming apparatus 1.

With reference to FIG. 1, a description is provided of an image forming operation performed by the image forming apparatus 1 having the construction described above to form a toner image on a sheet P.

As a print job starts, a driver drives and rotates the photoconductor 2 clockwise in FIG. 1 in a rotation direction R1. The charging roller 3 uniformly charges an outer circumferential surface of the photoconductor 2 at a predetermined polarity. Exposure light L emitted from the light source 4 irradiates and scans the charged outer circumferential surface of the photoconductor 2 via the mirror 5 according to image data sent from a scanner or an external device such as a client computer. Thus, an electrostatic latent image is formed on the outer circumferential surface of the photoconductor 2. The developing roller 6 supplies toner to the electrostatic latent image formed on the photoconductor 2, visualizing the electrostatic latent image into a toner image.

On the other hand, as the print job starts, the feed roller 12 is driven and rotated to pick up and feed an uppermost sheet P of the plurality of sheets P loaded on the paper tray 11 toward the registration roller pair 13. The registration roller pair 13 halts the sheet P temporarily and corrects skew of the sheet P. Thereafter, the registration roller pair 13 resumes rotation in synchronism with rotation of the photoconductor 2 to convey the sheet P to a transfer nip formed between the photoconductor 2 and the transfer device 8 at a time when a leading edge of the toner image formed on the photoconductor 2 corresponds to a predetermined position in a leading edge of the sheet P in a sheet conveyance direction A. As the toner image formed on the photoconductor 2 reaches the transfer nip, the toner image is transferred onto the sheet P conveyed through the transfer nip by a transfer electric field produced by the transfer device 8. The sheet P bearing the toner image is conveyed to the fixing device 14 that fixes the toner image on the sheet P. Thereafter, the sheet P bearing the fixed toner image is ejected by the output roller pair 15 onto the outside of the image forming apparatus 1.

As residual toner failed to be transferred onto the sheet P at the transfer nip and therefore remaining on the photoconductor 2 moves under the cleaner 10 in accordance with rotation of the photoconductor 2, the cleaning blade 9 scrapes the residual toner off the photoconductor 2, thus cleaning the photoconductor 2. Thereafter, a discharger discharges the outer circumferential surface of the photoconductor 2, rendering the photoconductor 2 to be ready for a next image forming operation.

Figure 2:
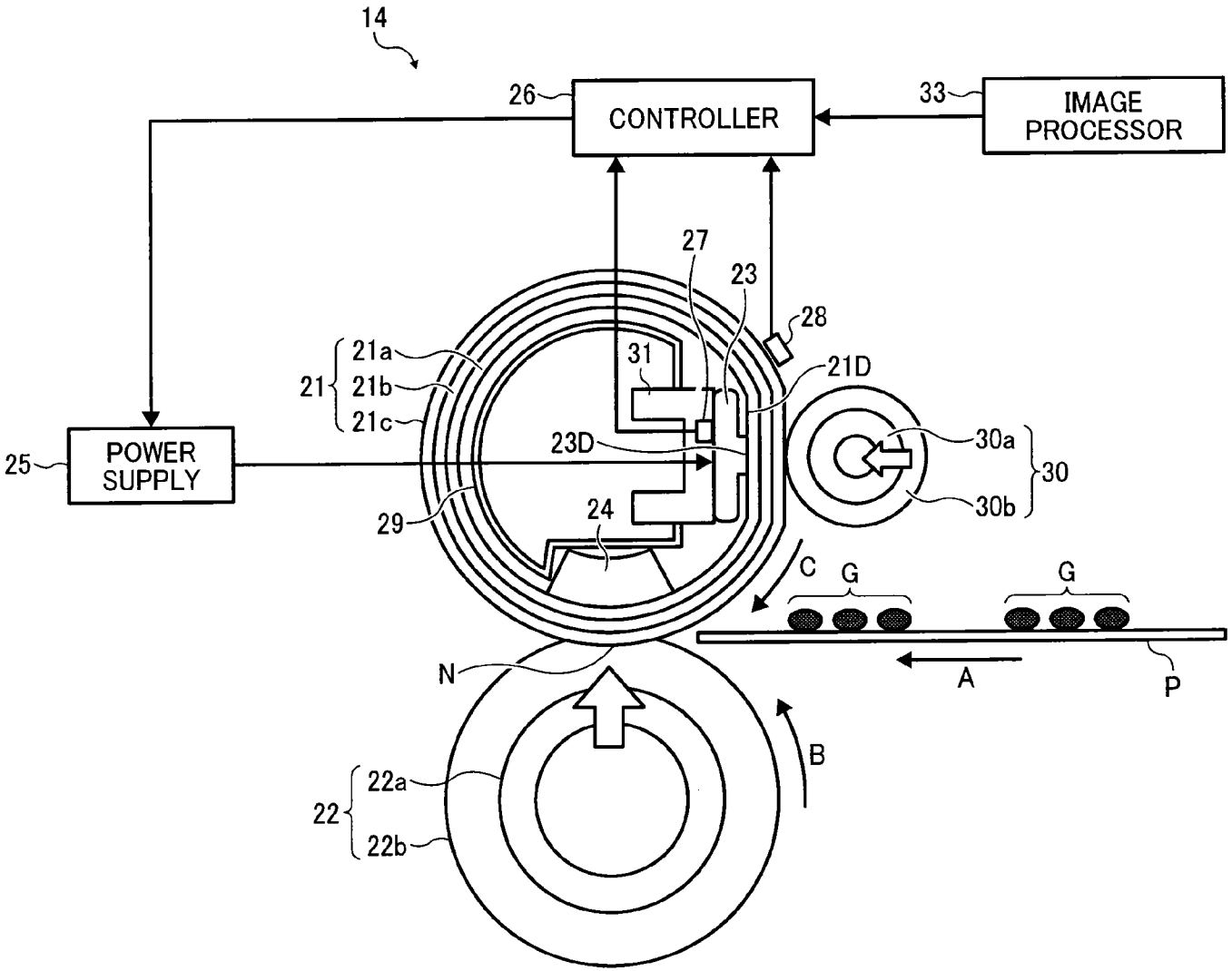
FIG. 2 is a schematic vertical sectional view of a fixing device incorporated in the image forming apparatus shown in FIG. 1.

With reference to FIG. 2, a description is provided of a construction of the fixing device 14 incorporated in the image forming apparatus 1 described above.

FIG. 2 is a schematic vertical sectional view of the fixing device 14. As shown in FIG. 2, the fixing device 14 (e.g., a fuser or a fusing unit) includes a fixing belt 21 serving as a fixing rotator or a fixing member; a pressure roller 22 contacting the fixing belt 21 to form a fixing nip N therebetween; and a heater 23 disposed opposite the fixing belt 21 to heat the fixing belt 21.

A detailed description is now given of a configuration of the fixing belt 21.

The fixing belt 21 is a thin, flexible endless belt or film. For example, the fixing belt 21 is constructed of a base layer 21*a* serving as a base made of polyimide; an elastic layer 21*b* coating an outer circumferential surface of the base layer 21*a* and made of silicone rubber; and a release layer 21*c* coating an outer circumferential surface of the elastic layer 21*b* and made of fluoroplastic such as tetrafluoroethylene-perfluoroalkylvinylether copolymer (PFA) and polytetrafluoroethylene (PTFE). The base layer 21*a* has an outer diameter of about 30 mm and a thickness in a range of from about 50 micrometers to about 70 micrometers. The elastic layer 21*b* has a thickness in a range of from about 50 micrometers to about 120 micrometers. The release layer 21*c* has a thickness in a range of from about 5 micrometers to about 50 micrometers. Alternatively, the base layer 21*a* may be made of metal such as SUS stainless steel and nickel or resin coating an inner circumferential surface of the fixing belt 21.

A detailed description is now given of a construction of the pressure roller 22.

The pressure roller 22, having an outer diameter of about 40 mm, is constructed of a cored bar 22*a* (e.g., a core metal) and an elastic layer 22*b* coating an outer circumferential surface of the cored bar 22*a*. The cored bar 22*a*, made of iron, has a thickness of about 2 mm. The elastic layer 22*b*, made of silicone rubber, has a thickness of about 5 mm. A release layer made of fluoroplastic and having a thickness of about 40 micrometers may coat an outer circumferential surface of the elastic layer 22*b* to facilitate separation of the sheet P from the pressure roller 22.

A nip formation pad 24 contacts the inner circumferential surface of the fixing belt 21 at the fixing nip N where the nip formation pad 24 is disposed opposite the pressure roller 22 via the fixing belt 21. The nip formation pad 24 is mounted on and supported by a side plate of the fixing device 14 at each lateral end of the nip formation pad 24 in a longitudinal direction thereof parallel to an axial direction of the fixing belt 21. A pressurization member such as a pressure lever presses the pressure roller 22 against the nip formation pad 24 via the fixing belt 21 to form the fixing nip N having a predetermined length in the sheet conveyance direction A between the pressure roller 22 and the fixing belt 21. Alternatively, the pressure roller 22 may merely contact the fixing belt 21 with no pressure therebetween.

A driver (e.g., a motor) drives and rotates the pressure roller 22 in a rotation direction B. As the driver drives and rotates the pressure roller 22, a driving force of the driver is transmitted from the pressure roller 22 to the fixing belt 21 at the fixing nip N, thus rotating the fixing belt 21 in a rotation direction C by friction between the pressure roller 22 and the fixing belt 21. Alternatively, the driver may also be connected to the fixing belt 21 to drive and rotate the fixing belt 21. A belt support 29 is disposed opposite the inner circumferential surface of the fixing belt 21 to support the fixing belt 21.

A detailed description is now given of a configuration of the heater 23.

The heater 23, disposed inside a loop formed by the fixing belt 21, includes a sheet or platy heat generator such as a thermal heater and a ceramic heater. A stay 31 is disposed opposite the inner circumferential surface of the fixing belt 21 to support the heater 23 in a state in which a contact face 23D of the heater 23 contacts a heated face 21D, that is, the inner circumferential surface, of the fixing belt 21 at a position upstream from the fixing nip N in the rotation direction C of the fixing belt 21 or the sheet conveyance direction A. A power supply 25 is connected to the heater 23 to supply power to the heater 23. A controller 26 operatively connected to the power supply 25 controls output of the power supply 25. For example, the controller 26 (e.g., a processor) is a micro computer including a central processing unit (CPU), a read-only memory (ROM), a random-access memory (RAM), and an input-output (I/O) interface.

The fixing device 14 further includes a first thermistor 27 that detects the temperature of the heater 23 and a second thermistor 28 that detects the temperature of the fixing belt 21. The first thermistor 27 contacts the heater 23 directly. Conversely, the second thermistor 28 is disposed opposite an outer circumferential surface of the fixing belt 21 at a position upstream from the heater 23 in the rotation direction C of the fixing belt 21. Each of the first thermistor 27 and the second thermistor 28 sends a detection result to the controller 26 operatively connected to the first thermistor 27 and the second thermistor 28. The controller 26 controls output of the power supply 25 based on the detection result.

A pressurization roller 30 is disposed opposite the outer circumferential surface of the fixing belt 21 and the heater 23. The pressurization roller 30 presses the fixing belt 21 against the heater 23 to bring the fixing belt 21 into contact with the heater 23. The pressurization roller 30 has an outer diameter in a range of from about 15 mm to about 30 mm and is constructed of a cored bar 30*a* (e.g., a core metal) and an elastic layer 30*b* coating an outer circumferential surface of the cored bar 30*a*. The cored bar 30*a*, made of iron, has an outer diameter of about 8 mm. The elastic layer 30*b*, made of silicone rubber, has a thickness in a range of from about 3.5 mm to about 11.0 mm. A release layer made of fluoroplastic and having a thickness of about 40 micrometers may coat an outer circumferential surface of the elastic layer 30*b* to facilitate separation of foreign substances from the pressurization roller 30. According to this exemplary embodiment, a pressurization member presses the pressurization roller 30 against the heater 23 via the fixing belt 21. Alternatively, the pressurization roller 30 may merely contact the fixing belt 21 with no pressure therebetween.

With reference to FIG. 2, a description is provided of a fixing operation performed by the fixing device 14 having the construction described above.

As the image forming apparatus 1 depicted in FIG. 1 is powered on, the power supply 25 supplies power to the heater 23 and the pressure roller 22 starts rotating in the rotation direction B. Accordingly, the fixing belt 21 is driven and rotated in the rotation direction C by friction between the fixing belt 21 and the pressure roller 22.

Thereafter, as a sheet P bearing a toner image G formed on the sheet P through the image forming processes described above with reference to FIG. 1 is conveyed through the fixing nip N formed between the fixing belt 21 and the pressure roller 22, the fixing belt 21 and the pressure roller 22 fix the toner image G on the sheet P under heat and pressure. Then, the sheet P bearing the fixed toner image G is discharged from the fixing nip N and ejected onto the outside of the image forming apparatus 1.

A description is provided of a configuration of the fixing device 14 in detail.

Figure 3:
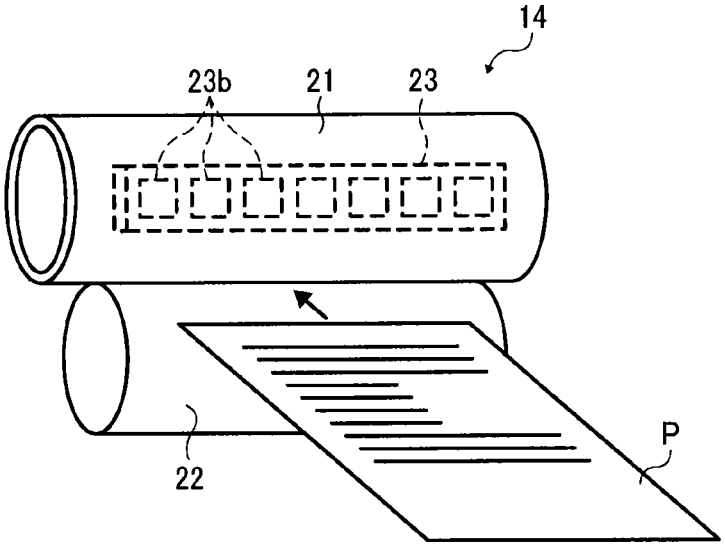
FIG. 3 is a partial perspective view of the fixing device shown in FIG. 2.

FIG. 3 is a partial perspective view of the fixing device 14. As shown in FIG. 3, the heater 23 includes a plurality of heat generators 23*b*, for example, seven heat generators 23*b* according to this exemplary embodiment, aligned in a longitudinal direction of the heater 23, that is, a width direction of the sheet P perpendicular to the sheet conveyance direction A with an identical gap between the adjacent heat generators 23*b*. Each heat generator 23*b* is connected to the power supply 25 depicted in FIG. 2 such that the power supply 25 supplies power to each heat generator 23*b* independently. The controller 26 controls power supply to each heat generator 23*b* through the power supply 25 independently.

For example, the controller 26 performs three changes. First, the controller 26 changes an axial heating span of the heater 23 in the axial direction of the fixing belt 21 parallel to the width direction of the sheet P by selectively actuating one or more heat generators 23*b* of the seven heat generators 23*b*. Secondly, the controller 26 changes a circumferential heating span of the heater 23 in the rotation direction C of the fixing belt 21 by controlling a time to turn on and off the heat generators 23*b*. Thirdly, the controller 26 changes an amount of heat generation per unit time, that is, a heating temperature, by controlling the amount of heat generation of the heat generators 23*b*. The controller 26 controls the amount of heat generation, that is, output, of the heat generators 23*b* by changing power supplied to each heat generator 23*b*. Power supply to each heat generator 23*b* is changed by analog change of the voltage or change of the lighting duty (e.g., a rate of turn-on time in a predetermined time).

An image signal sent from the scanner of the image forming apparatus 1 depicted in FIG. 1 or the external device enters an image processor 33 depicted in FIG. 2 that performs predetermined image processing. The image processor 33 sends image data to the controller 26 that controls output of each heat generator 23*b* through the power supply 25 based on the image data.

Figure 4A:
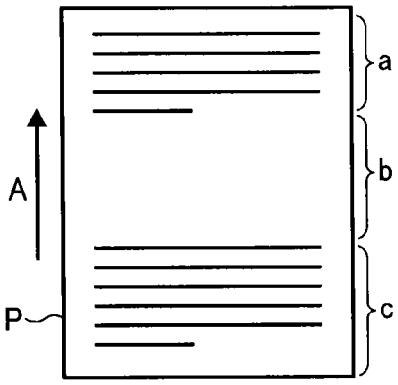
FIG. 4A is a plan view of a sheet conveyed through the fixing device shown in FIG. 2, illustrating a first image pattern.

FIG. 4A is a plan view of the sheet P illustrating a first image pattern. As shown in FIG. 4A, the sheet P has an image area a, a blank area b, and an image area c arranged in this order from a leading edge of the sheet P to a trailing edge of the sheet P in the sheet conveyance direction A. The image areas a and c need fixing. Conversely, the blank area b does not need fixing. In this case, the controller 26 controls the heater 23 according to the image data obtained from the image processor 33 such that a temperature of a portion of the fixing belt 21 corresponding to the blank area b on the sheet P is lower than a temperature of a portion of the fixing belt 21 corresponding to the image areas a and c. For example, the controller 26 controls the power supply 25 to supply a regular amount of power to all of the heat generators 23*b* disposed opposite the portion of the fixing belt 21 corresponding to the image areas a and c. Conversely, the controller 26 controls the power supply 25 to supply a reduced amount of power or no power to all of the heat generators 23*b* disposed opposite the portion of the fixing belt 21 corresponding to the blank area b. Accordingly, the fixing device 14 reduces unnecessary heat supply to the blank area b on the sheet P, decreasing waste of energy.

Figure 4B:
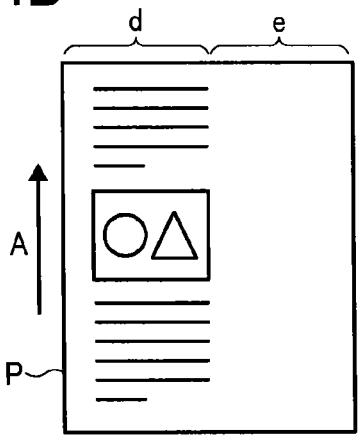
FIG. 4B is a plan view of a sheet conveyed through the fixing device shown in FIG. 2, illustrating a second image pattern.

FIG. 4B is a plan view of the sheet P illustrating a second image pattern. As shown in FIG. 4B, the sheet P has an image area d and a blank area e arranged in the width direction of the sheet P perpendicular to the sheet conveyance direction A. In this case, the controller 26 controls the power supply 25 to supply a reduced amount of power or no power to one or more heat generators 23*b* of the seven heat generators 23*b* that is disposed opposite a portion of the fixing belt 21 corresponding to the blank area e. Accordingly, the fixing device 14 reduces unnecessary heat supply to the blank area e on the sheet P, decreasing waste of energy.

Figure 4C:
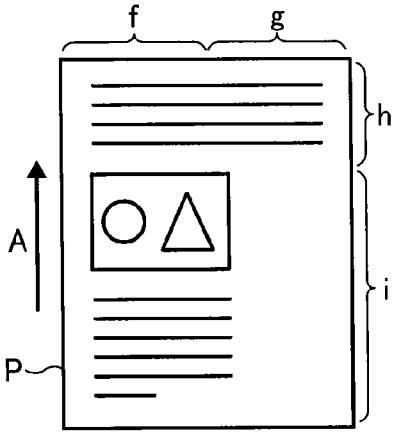
FIG. 4C is a plan view of a sheet conveyed through the fixing device shown in FIG. 2, illustrating a third image pattern.

FIG. 4C is a plan view of the sheet P illustrating a third image pattern. As shown in FIG. 4C, the sheet P has an image area and a blank area mixed in the width direction of the sheet P and the sheet conveyance direction A. For example, the sheet P has an image area f and an image area g arranged in the width direction of the sheet P and an image area h and a blank area i arranged in the sheet conveyance direction A. In this case, the controller 26 controls the power supply 25 to supply a reduced amount of power or no power to one or more heat generators 23*b* of the seven heat generators 23*b* that is disposed opposite a portion of the fixing belt 21 corresponding to the blank area i. Accordingly, the fixing device 14 reduces unnecessary heat supply to the blank area i on the sheet P, decreasing waste of energy.

Figure 5:
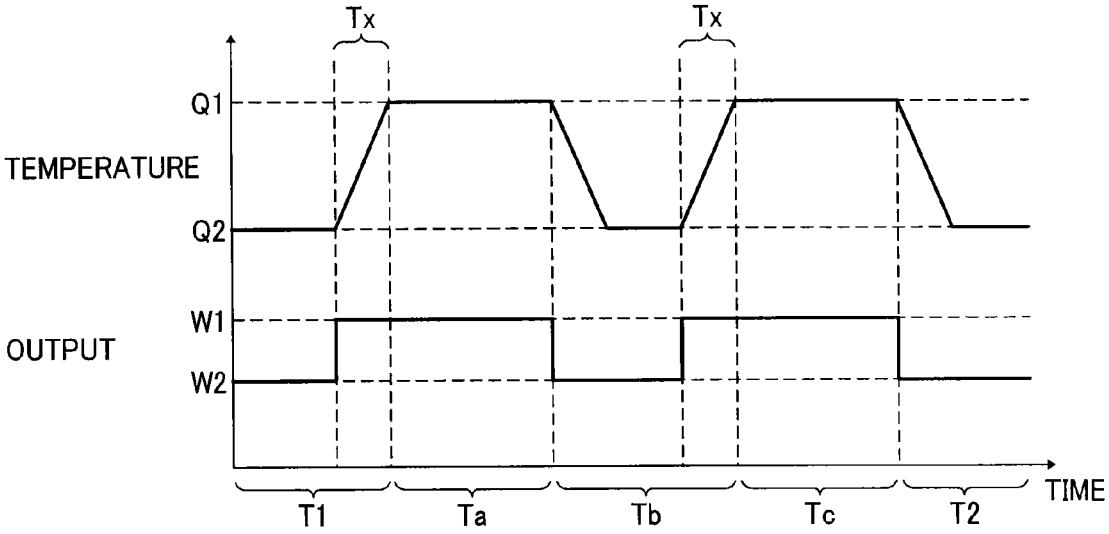
FIG. 5 is a graph showing change in output of a heater and the temperature of a fixing belt of the fixing device shown in FIG. 2 over time as the sheet having the first image pattern shown in FIG. 4A is conveyed through a fixing nip of the fixing device.

With reference to FIG. 5, a description is provided of control of the temperature of the fixing belt 21.

FIG. 5 is a graph showing change in output of the heater 23 and the temperature of the fixing belt 21 over time as the sheet P having the first image pattern shown in FIG. 4A is conveyed through the fixing nip N.

As shown in FIG. 5, during time periods Ta and Tc when the image areas a and c on the sheet P pass through the fixing nip N, respectively, the controller 26 controls the power supply 25 to supply power to the heat generators 23*b* such that the fixing belt 21 is heated to a first target temperature Q1 at which the toner image G is fixed on the sheet P properly. Conversely, during a time period Tb when the blank area b on the sheet P passes through the fixing nip N, the controller 26 controls the power supply 25 to supply a reduced amount of power to the heat generators 23*b* such that the fixing belt 21 is heated to a second target temperature Q2 lower than the first target temperature Q1, thus reducing waste of energy. During the time period Tb, a time period T1, and a time period T2 when the image areas a and c on the sheet P do not pass through the fixing nip N, the controller 26 may control the power supply 25 to stop power supply to the heat generators 23*b*. However, if the temperature of the fixing belt 21 is lowered excessively, the fixing belt 21 may not have been heated to the first target temperature Q1 when the subsequent image area on the sheet P or a leading image area on the next sheet P enters the fixing nip N. To address this circumstance, as shown in FIG. 5, an output W2 smaller than an output W1 to heat the fixing belt 21 to the first target temperature Q1 is defined for the heat generators 23*b*. During the time periods Tb, T1, and T2 when the image areas a and c do not pass through the fixing nip N, the controller 26 controls the power supply 25 to heat the fixing belt 21 with the smaller output W2 to retain the temperature of the fixing belt 21 at the second target temperature Q2 lower than the first target temperature Q1 and higher than an ambient temperature.

A predetermined heating time is taken after the heater 23 starts heating the fixing belt 21 until the fixing belt 21 is heated to a target temperature. Accordingly, if the heater 23 starts heating the fixing belt 21 with the output W1 for the first target temperature Q1 when a leading edge of the image area a reaches the fixing nip N, heating of the fixing belt 21 to the first target temperature Q1 may be delayed. To address this circumstance, as shown in FIG. 5, in view of the predetermined heating time taken to heat the fixing belt 21 to the first target temperature Q1, the heater 23 preheats the fixing belt 21 with the output W1 for a predetermined preheating time period Tx before the leading edge of the image areas a and c reaches the fixing nip N. The preheating time period Tx is as short as possible to save energy. The predetermined heating time taken to heat the fixing belt 21 to the first target temperature Q1 varies depending on the thermal conductivity of the fixing belt 21 and the length of the heat generators 23*b* in the rotation direction C of the fixing belt 21. Hence, the predetermined heating time taken to heat the fixing belt 21 to the first target temperature Q1 is preset by an experiment or the like.

As shown in FIG. 5, the identical first target temperature Q1 is applied to the image areas a and c. Alternatively, different target temperatures may be applied to the image areas a and c, respectively.

For example, if the image type (e.g., character, photograph, and drawing) differs between the image areas a and c, the target temperature of the image areas a and c may vary depending on the image type. If the image type is photograph, it may be necessary to enhance the glossiness of the image. Hence, an increased target temperature is applied to the photographic image area to achieve a desired glossiness.

Further, the target temperature of the image areas a and c may also vary depending on an image pattern (e.g., a solid image, a halftone image, a linear image, and a text image) and an image pattern processing method (e.g., a dither method and an error diffusion method). Isolation or congestion of toner particles vary depending on the image pattern. Toner particles isolated from each other are susceptible to peeling off from the sheet P than congested toner particles. Accordingly, an increased target temperature is applied to an image pattern formed of isolated toner particles to prevent toner particles from peeling off the sheet P. Conversely, a decreased target temperature is applied to an image pattern formed of congested toner particles to reduce energy consumption.

Since a desired fixing temperature varies depending on an amount of toner adhered to the image areas a and c, the target temperature of the image areas a and c may also vary depending on the amount of toner adhered to the image areas a and c. The target temperature may be determined by calculating an amount of toner adhered to the image areas a and c according to image data. An increased target temperature is applied to an image formed of an increased amount of toner because an increased amount of heat is needed to melt toner of the image. Conversely, a decreased target temperature is applied to an image formed of a decreased amount of toner to reduce energy consumption.

In a color image forming apparatus using toner in a plurality of colors that may require a plurality of different amounts of heat to fix the toner image G on the sheet P, respectively, the target temperature of the image areas a and c may also vary depending on the color of toner. For example, black toner may require a decreased amount of heat to fix a black toner image on the sheet P compared to toner in other colors, that is, yellow, cyan, magenta, and the like. Hence, a decreased target temperature is applied to an image area formed of black toner to reduce energy consumption.

As shown in FIG. 2, the fixing device 14 includes the fixing belt 21 having a decreased thickness that decreases the thermal capacity thereof. Hence, the fixing belt 21 is heated quickly with a decreased amount of heat.

However, the thin fixing belt 21 has an insufficient resistance against abrasion. For example, after long term use, the fixing belt 21 may suffer from abrasion due to friction between the heater 23 and the fixing belt 21 sliding thereover, resulting in fixing failure.

A description is provided of a construction of the heater 23 incorporated in the fixing device 14 to reduce abrasion of the fixing belt 21.

Figure 6:
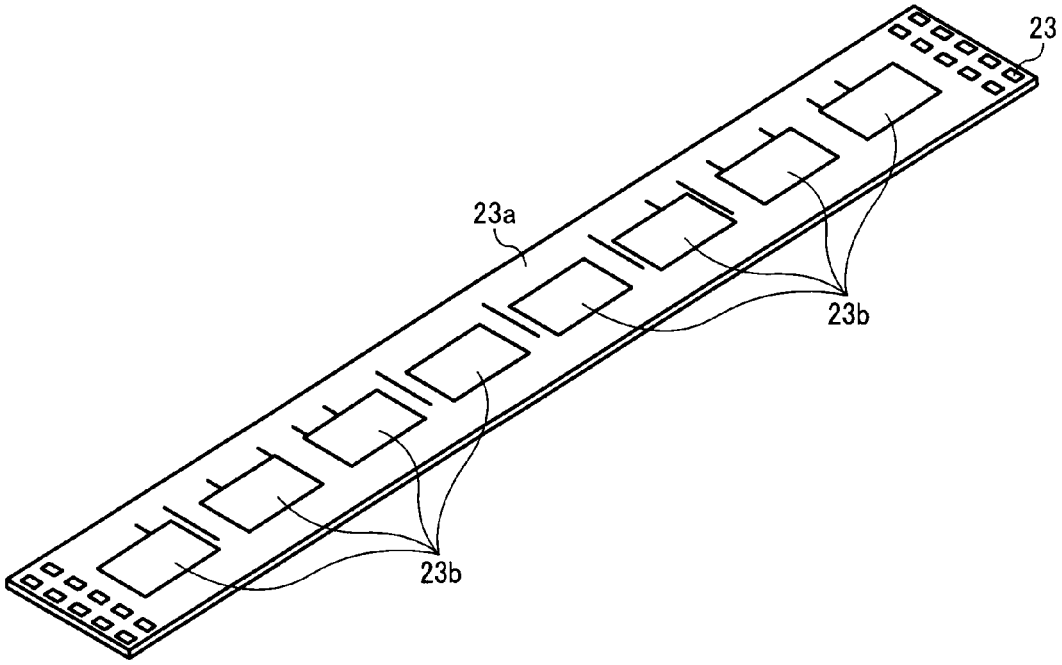
FIG. 6 is a perspective view of the heater incorporated in the fixing device shown in FIG. 2.

FIG. 6 is a perspective view of the heater 23 incorporated in the fixing device 14. As shown in FIG. 6, the heater 23 includes a glass substrate 23*a* having a thickness of about 0.7 mm and mounting the plurality of heat generators 23*b*.

Figure 7:
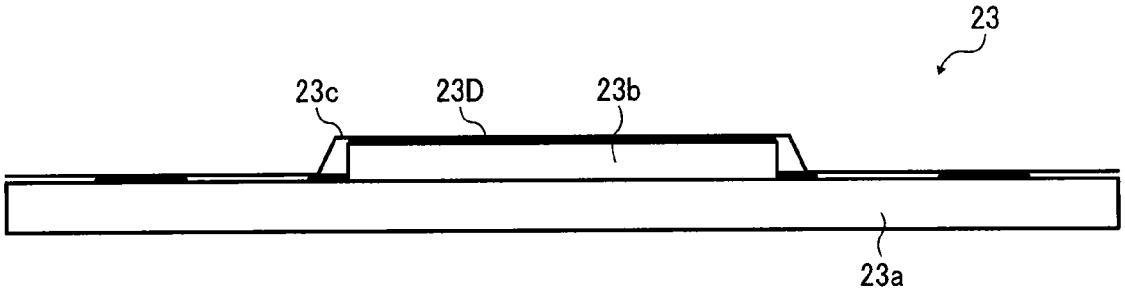
FIG. 7 is a sectional view of the heater shown in FIG. 6.

FIG. 7 is a sectional view of the heater 23. As shown in FIG. 7, the contact face 23D of the heater 23 that contacts the heated face 21D of the base layer 21*a* of the fixing belt 21 is coated with an insulator 23*c* made of insulative glass or the like. The plurality of heat generators 23*b* constitutes the contact face 23D. The contact face 23D of the heater 23 contacts the heated face 21D of the fixing belt 21 to heat the fixing belt 21. Alternatively, the insulator 23*c* made of glass or the like and coating the contact face 23D may mount a separate component or may be coated with another coating member to produce double coating on the contact face 23D.

As described above with reference to FIG. 2, as the pressure roller 22 rotates in the rotation direction B, the fixing belt 21 rotates in the rotation direction C in accordance with rotation of the pressure roller 22. Since the heater 23 is mounted on the stay 31, as the fixing belt 21 rotates in the rotation direction C, the heated face 21D of the fixing belt 21 slides over the contact face 23D of the stationary heater 23 with friction therebetween. As friction generates between the fixing belt 21 and the heater 23, if a hardness of the base layer 21*a* constituting the heated face 21D is smaller than a hardness of the contact face 23D of the heater 23 substantially, the base layer 21*a* may suffer from substantial abrasion.

The base layer 21*a* is made of polyimide and has a Vickers hardness of about 50 Hv. Accordingly, the contact face 23D coated with the insulator 23*c* has a Vickers hardness not greater than about 600 Hv so that a difference between the Vickers hardness of the heated face 21D, that is, the base layer 21*a*, and the Vickers hardness of the contact face 23D is not greater than about 580 Hv. The difference in the Vickers hardness between the contact face 23D of the heater 23 and the heated face 21D of the fixing belt 21 is not greater than the predetermined value, suppressing abrasion of the base layer 21*a* of the fixing belt 21 and attaining stable fixing operation for an extended time.

Abrasion of the base layer 21*a* of the fixing belt 21 is affected by the kinetic friction coefficient and the surface roughness in addition to the hardness of the heated face 21D of the fixing belt 21 and the contact face 23D of the heater 23. To address this circumstance, the kinetic friction coefficient of the contact face 23D with respect to the heated face 21D is not greater than about 0.3 and the surface roughness of the contact face 23D is not greater than about 0.3 micrometers.

Figure 8:
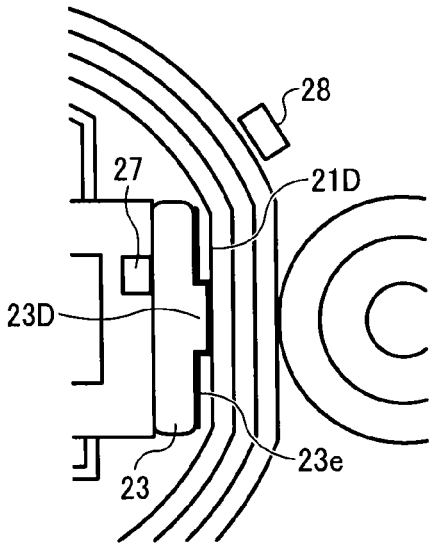
FIG. 8 is a partially enlarged vertical sectional view of the fixing device shown in FIG. 2.

FIG. 8 is a partially enlarged vertical sectional view of the fixing device 14. As shown in FIG. 8, a lubricant 23*e* made of fluorine or silicone is applied between the contact face 23D of the heater 23 and the heated face 21D of the fixing belt 21 to reduce friction therebetween.

Figure 9:
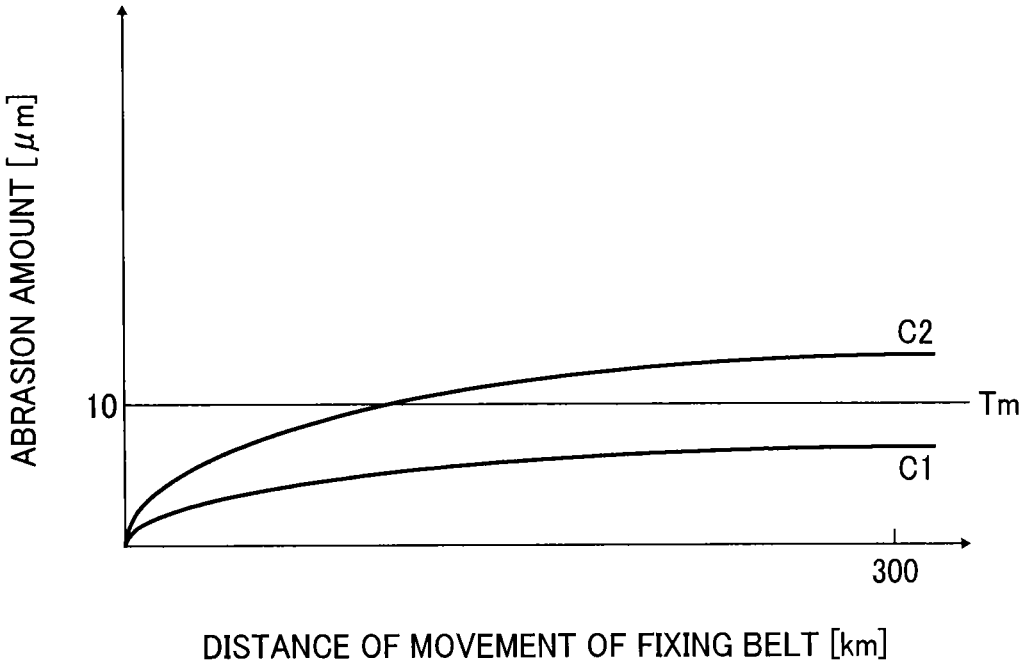
FIG. 9 is a graph showing a relation between the distance of movement of the fixing belt and abrasion of the fixing belt incorporated in the fixing device shown in FIG. 2.

FIG. 9 is a graph showing a relation between the distance of movement of the fixing belt 21 and abrasion of the fixing belt 21. In FIG. 9, Tm represents a target abrasion amount of the base layer 21*a* of the fixing belt 21. C1 represents an abrasion curve of the fixing belt 21 having the configuration described above to reduce abrasion. C2 represents an abrasion curve of a comparative fixing belt not having the configuration to reduce abrasion. With the heater 23 and the fixing belt 21 having the configuration to reduce abrasion described above, as shown in FIG. 9 by the abrasion curve C1, when the fixing belt 21 moves for 300 kilometers, abrasion of the base layer 21*a* of the fixing belt 21 is suppressed to 10 micrometers or less.

Figure 10:
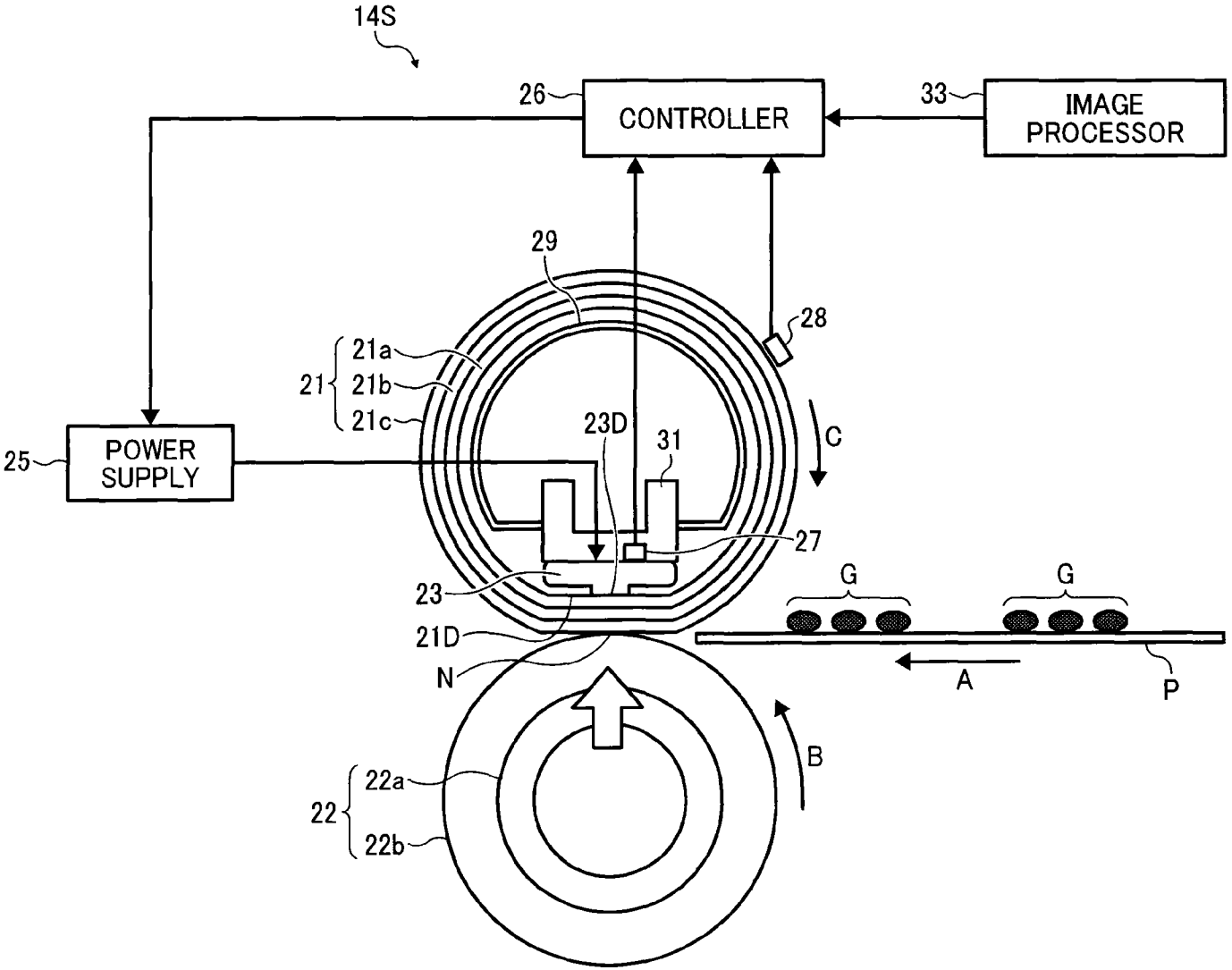
FIG. 10 is a schematic vertical sectional view of a fixing device according to another exemplary embodiment of the present disclosure.

With reference to FIG. 10, a description is provided of a construction of a fixing device 14S according to another exemplary embodiment.

FIG. 10 is a schematic vertical sectional view of the fixing device 14S. As shown in FIG. 10, the fixing device 14S includes the heater 23 disposed opposite the inner circumferential surface of the fixing belt 21 at the fixing nip N. The heater 23, instead of the nip formation pad 24 depicted in FIG. 2, presses against the pressure roller 22 via the fixing belt 21 to form the fixing nip N between the fixing belt 21 and the pressure roller 22. The heater 23 pressingly contacting the fixing belt 21 heats the fixing belt 21. Hence, the fixing device 14S does not incorporate the pressurization roller 30 depicted in FIG. 2.

A description is provided of advantages of the heater 23 installed in the fixing devices 14 and 14S.

As shown in FIGS. 2 and 10, the heater 23 for heating the fixing belt 21 serving as a fixing rotator or a fixing member that fixes the toner image G on the sheet P includes the contact face 23D that contacts the heated face 21D of the fixing belt 21. The contact face 23D of the heater 23 has a Vickers hardness not greater than about 600 Hv.

Accordingly, the hardness of the contact face 23D of the heater 23 that contacts the heated face 21D of the fixing belt 21 is adjusted to a value not greater than the predetermined value to restrict or decrease the difference between the hardness of the heated face 21D of the fixing belt 21 and the hardness of the contact face 23D of the heater 23, preventing sharp abrasion of the fixing belt 21.

According to the exemplary embodiments described above, the fixing devices 14 and 14S are installable in the monochrome image forming apparatus 1 shown in FIG. 1 that forms a monochrome toner image on a recording medium. Alternatively, the fixing devices 14 and 14S may be installed in a color image forming apparatus that forms a color toner image on a recording medium.

According to the exemplary embodiments described above, the fixing belt 21 serves as a fixing rotator. Alternatively, a fixing film, a fixing sleeve, or the like may be used as a fixing rotator. Further, the pressure roller 22 serves as a pressure rotator. Alternatively, a pressure belt or the like may be used as a pressure rotator.

The present disclosure has been described above with reference to specific exemplary embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. An image forming apparatus comprising:
an image bearer to bear a toner image;
a fixing device, disposed downstream from the image bearer in a recording medium conveyance direction, to fix the toner image on a recording medium,
the fixing device including:
a fixing rotator rotatable in a predetermined direction of rotation and including a heated face:
a pressure rotator to press against the fixing rotator;
a heater including:
a fixed contact face contacting the heated face of the fixing rotator, the fixed contact face having a Vickers hardness not greater than about 600 Hv; and
a plurality of heat generators aligned in a longitudinal direction of the heater;
a nip formation pad disposed opposite the pressure rotator via the fixing rotator and in contact with an inner circumferential surface of the fixing rotator, and the nip formation pad is disposed downstream from the fixed contact face of the heater in the rotation direction of the fixing rotator; and
a pressurization roller that is disposed opposite the fixed contact face of the heater;
a first temperature sensor in direct contact with the heater;
a second temperature sensor disposed opposite of the fixing rotator at a position upstream from the heater in the rotation direction of the fixing rotator; and
a controller that receives detection results from the first and second temperature sensors and the controller is configured to control a power supply to the plurality of heat generators based on the detection results from the first and second temperature sensors.

2. The image forming apparatus of claim 1, wherein a difference in the Vickers hardness between the fixed contact face of the heater and the heated face of the fixing rotator is not greater than about 580 Hv.

3. The image forming apparatus of claim 1, further comprising an insulator coating the fixed contact face of the heater,
wherein the heated face of the fixing rotator is made of polyimide.

4. The image forming apparatus of claim 3, wherein the insulator has a kinetic friction coefficient with respect to the heated face of the fixing rotator that is not greater than about 0.3.

5. The image forming apparatus of claim 3, wherein the insulator has a surface roughness not greater than about 0.3 micrometers.

6. The image forming apparatus of claim 3, wherein the insulator is made of insulative glass.

7. The image forming apparatus of claim 1, further comprising a lubricant made of one of fluorine and silicone applied between the heated face of the fixing rotator and the fixed contact face of the heater.

8. The image forming apparatus of claim 1, wherein the heater further includes:
a glass substrate,
wherein the plurality of heat generators are mounted on the glass substrate and constitutes the fixed contact face.

9. The image forming apparatus of claim 1, wherein the heater is disposed inside a loop formed by the fixing rotator.

10. The image forming apparatus of claim 1, wherein the fixing rotator includes a fixing belt.

11. The image forming apparatus of claim 10, wherein the fixing belt includes a base layer made of polyimide and including the heated face.

12. The image forming apparatus of claim 1, further comprising an image processor configured to send image data to the controller,
wherein the controller controls an amount of power supplied to the plurality of heat generators based on the image data.

13. The image forming apparatus of claim 1, wherein the controller is configured to control an axial heating span of the heater in an axial direction of fixing rotator by selectively actuating one or more of the plurality of heat generators.

14. The image forming apparatus of claim 1, wherein the controller is configured to control a circumferential heating span of the heater in the predetermined direction of rotation of the fixing rotator by turning on and off the heat generators.

15. The image forming apparatus of claim 1, wherein the controller is configured to control an amount of power supplied to each of the plurality of heat generators.

16. The image forming apparatus of claim 1, wherein the pressure rotator contacts the fixing rotator to form a fixing nip in which the toner image is fixed on the recording medium,
the pressurization roller is disposed opposite an outer circumferential surface of the fixing rotator, and
the heater and the pressurization roller are upstream from the fixing nip.

17. The image forming apparatus of claim 1, wherein the second temperature sensor is disposed opposite an outer circumferential surface of the fixing rotator at the position upstream from the heater in the rotation direction of the fixing rotator.

18. The image forming apparatus of claim 1, wherein the pressurization roller is a roller that does not include a heat generator.

* * * * *